United States Patent [19]

Eisinger et al.

[11] 4,212,278

[45] Jul. 15, 1980

[54] SAFETY DEVICE FOR DIESEL ENGINES

[75] Inventors: Norbert Eisinger, Mannheim; Paul Wesch, Ilvesheim; Matthias Dzsida, Mannheim, all of Fed. Rep. of Germany

[73] Assignee: Motoren-Werke Mannheim AG, Mannheim, Fed. Rep. of Germany

[21] Appl. No.: 928,075

[22] Filed: Jul. 26, 1978

[30] Foreign Application Priority Data

Jul. 29, 1977 [DE] Fed. Rep. of Germany ..... 2734215

[51] Int. Cl.[2] ..... F02B 77/08

[52] U.S. Cl. ..... 123/319; 123/198 D; 123/198 DB; 73/112

[58] Field of Search ..... 123/139 AZ, 139 T, 139 E, 123/198 D, 198 DB, 32 ES, 32 EK; 73/133 R, 112

[56] References Cited

U.S. PATENT DOCUMENTS

| | | | |
|---|---|---|---|
| 2,430,310 | 11/1947 | Stratton | 73/133 |
| 2,836,162 | 5/1958 | Dressler | 123/139 T |
| 3,686,935 | 8/1972 | May | 73/112 |
| 3,973,537 | 8/1976 | Williams et al. | 123/139 E |
| 3,978,837 | 9/1976 | Lundberg | 123/139 E |

FOREIGN PATENT DOCUMENTS 764608 12/1956 United Kingdom .

*Primary Examiner*—Ronald H. Lazarus
*Assistant Examiner*—Magdalen Moy
*Attorney, Agent, or Firm*—Haseltine, Lake & Waters

[57] ABSTRACT

A safety arrangement for diesel engines to respond to an abnormal change of the ratio of the useful torque delivered by the diesel engine and the fuel quantity per power stroke. The latter is defined by the position of control rod of the injection pump. A transducer converts the control rod displacement into a mechanical or electrical control variable which is at least approximately proportional to the fuel quantity per power stroke. The control rod displacement is converted by a crank drive into a rotation of a correcting element, and the ratio of connecting rod length to crank radius is in the range between 6:1 and 8:1. The rotation angle of the correcting element is less than 90° in the range between zero and full useful torque. The rotation angle range on either side of the crank position is 90°. An electrical control variable may be generated by a transducer which is free of contacts and supplies a direct current signal proportional to the rotation angle of the correcting element.

10 Claims, 3 Drawing Figures

SAFETY DEVICE FOR DIESEL ENGINES

BACKGROUND OF THE INVENTION

The present invention relates to a safety device for diesel engines which responds to an abnormal change of the ratio between the useful torque delivered by the diesel engine and the fuel quantity per power stroke. The latter is defined by the position of the control rod of the injection pump of the diesel engine.

Such a device has been described, for example, in British Pat. No. 764,608. With this known device, the position of the control rod of the injection pump of the diesel engine is converted directly into an electrical signal. However, this does not provide a signal proportional to the fuel quantity per power stroke throughout the entire range of the useful torque so that the known device is not in a position to distinguish the abnormal changes in the ratio of useful torque to fuel quantity. These changes might endanger operation, clearly from the other changes in this ratio.

Among these other changes is, for example, the change in the above-mentioned ratio which occurs with sudden changes of the useful torque where the speed-regulating device of the diesel engine increases or reduces the fuel quantity disproportionally. A fuel quantity proportional to the new useful torque will attain a settled value only after the so called control stabilization period.

Contrasting thereto, an abnormal change caused by a condition impairing the operation develops when the friction torque of the diesel engine suddenly rises, for example, due to jamming or seizing of a piston in its cylinder. In that case, the fuel quantity supplied per power stroke is no longer proportional to the useful torque because a disproportionately large amount of fuel must be supplied so that the engine may overcome its vastly increased internal friction torque.

An abnormal change caused by a condition which might impair operation also develops if one cylinder of the diesel engine does not fire, for example, due to a defective injection nozzle, and thus does not produce a useful torque. In that case, the remaining cylinders must take on the work of the missing cylinder, increasing the fuel quantity per power stroke while the useful torque remains the same.

Accordingly, it is the object of the present invention to provide a safety device which responds only to the disproportionality between fuel quantity and useful torque which occurs under conditions which might impair operation, but does not react to other disproportions occurring in normal operation.

Another object of the present invention is to provide a safety device of the foregoing character which is substantially simple in construction and may be economically fabricated.

A further object of the present invention is to provide a safety arrangement, as described, which may be readily maintained in service and which has a substantially long operating life.

SUMMARY OF THE INVENTION

The objects of the present invention are achieved by providing that the control rod displacement is converted into a mechanical or electrical control variable at least approximately proportional to the fuel quantity per power stroke.

In this manner, it is possible to use the control rod displacement, even though it is not proportional to the fuel quantity per power stroke throughout the entire operating range, for triggering a safety shutoff.

A simple construction of the device is obtained by converting the linear control rod displacement via a crank drive into a rotation of a correcting element.

According to a preferred embodiment of the present invention, the required proportionality is achieved by making the ratio control rod to crank radius in the range 6:1 to 8:1, making the rotation angle of the correcting element in the range between zero and the full useful torque less than 90°, and the rotation angle range on either side of the crank position 90° or 270°.

The device is made insensitive to impacts and vibrations as occur in a running diesel engine by having the electrical control variable generated by a contactless transducer delivering a dc signal proportional to the rotation angle of the correcting control element.

The device is adapted for use on diesel power generation units operating at nearly constant speed by applying to an electrical comparator, the electrical signal which is nearly proportional to the fuel quantity per power stroke, plus an electrical signal proportional to the output of the generator, which nearly cancel each other during normal operation of the unit. The electrical comparator delivers a warning signal or shuts down the diesel engine in case of abnormal preponderance of one of the two signals.

This device not only responds to the above conditions which might impair operations, but also when the generator operates as a motor with line current and drives the diesel engine.

The above-mentioned disproportions between useful torque and fuel quantity per power stroke that occur with sudden changes of the useful torque during the control stabilization period of the speed regulating device, are advantageously made ineffective by having the change in ratio of useful torque to fuel quantity act on the shut-off device via a delay element whose time lag at least equals the control stabilization period of the speed regulating device.

So that the electrical signal nearly proportional to the fuel quantity per power stroke, and the electrical signal proportional to the output of the generator during normal operation of the unit nearly cancel each other, a fixed control magnitude is superimposed on the control variable to allow for the normal engine friction torque.

The accuracy with which the two signals mentioned above cancel each other can be improved by superimposing on the control variable which corresponds to the fuel quantity per power stroke an additional fixed control magnitude to allow for the torque representing the idling losses of the generator.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
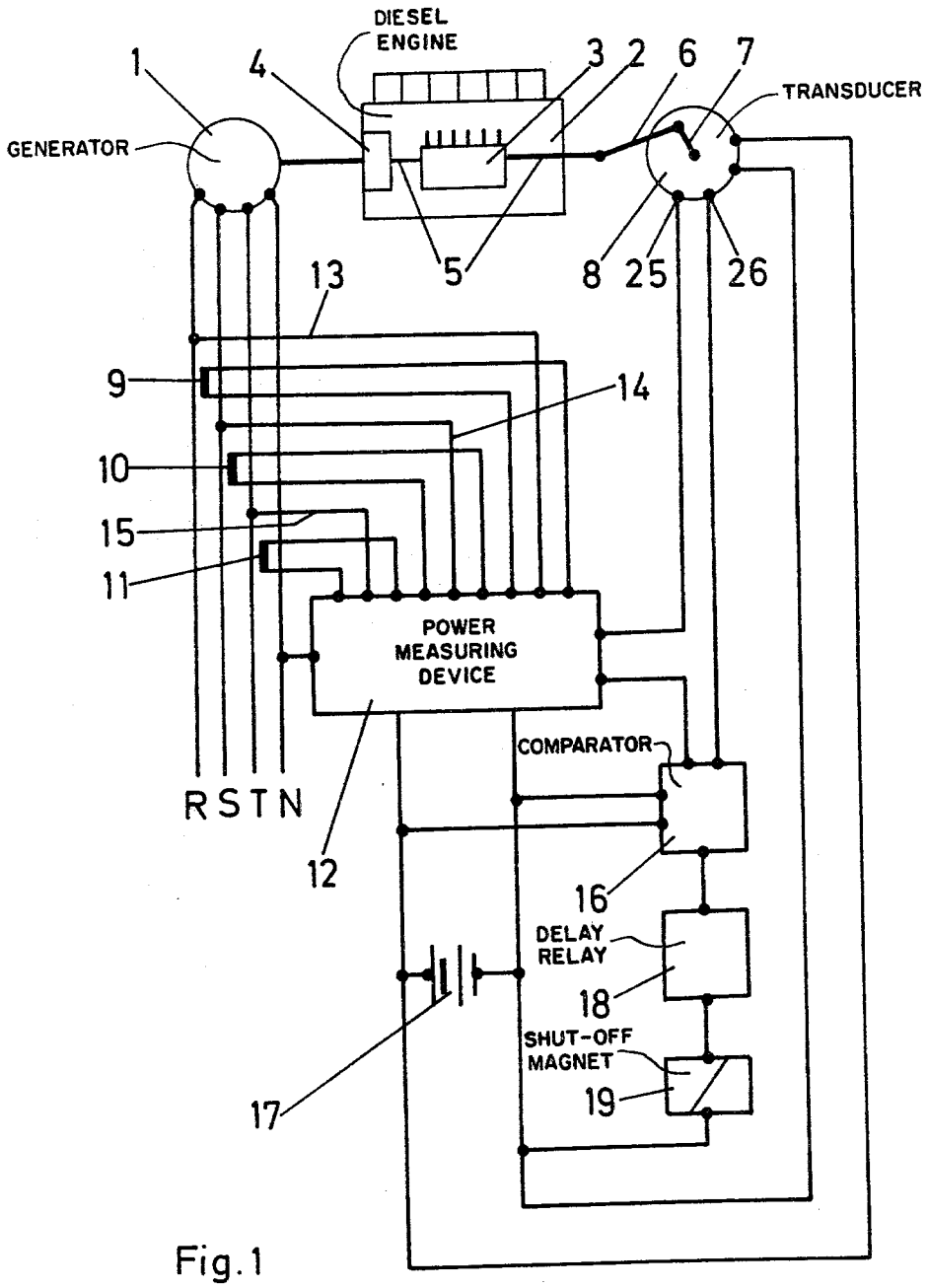
FIG. 1 shows a schematic of the complete device.

The schematic in FIG. 1 shows a safety device for diesel units for generating three-phase current. The three-phase current generator 1 is driven by a diesel engine 2 equipped with a fuel injection pump 3 whose delivery per power stroke is controlled by the speed regulator 4 between idling and full load or overload under normal operating conditions, only as a function of the useful torque of the diesel engine. The fuel quantity supplied to the diesel engine per power stroke is changed in that the speed regulator 4 displaces the control rod 5 in its longitudinal direction. This movement is transmitted by the connecting rod 6 and the crank arm 7 to the transducer 8. The lines R, S, T leading to the loads (not shown) from generator 1 are associated with transducers 9, 10, 11 for measuring the current amperage. Transducers 9, 10, 11 are connected to the power measuring device 12, as are lines 13, 14, 15 which are used for measuring voltage. Hence device 12 measures the output of generator 1. Since the generator 1 runs at constant or nearly constant speed throughout the entire load range, the measured output is also a measure of the useful torque of the diesel engine, reduced by the internal losses of the generator. The measuring device 12, like transducer 8 and comparator 16 are furnished direct current by current source 17. The output signals of measuring device 12 and of transducer 8 are supplied with opposite polarity to comparator 16, which may be a differential amplifier. If the two signals cancel each other or if the difference is below a certain value, nothing happens. However, if the above-mentioned limit value is exceeded, the comparator 16, via the delay relay 18, delivers a pulse to the shut-off magnet 19 which shuts off the diesel engine. The time lag of relay 18 is slightly larger than the control stabilization time of speed regulator 4. The diesel engine may be shut off by displacing the control rod 5 to its zero position, by blowing out the injection pump 3 with compressed air, by shutting off the intake air of the diesel engine or by several of the above measures. Also, the generator 1 is separated from the loads as soon as an optical and/or acoustic alarm is set off. The alarm may be set off first, with the shut-off taking place after a preset delay period (time lag).

Figure 2:
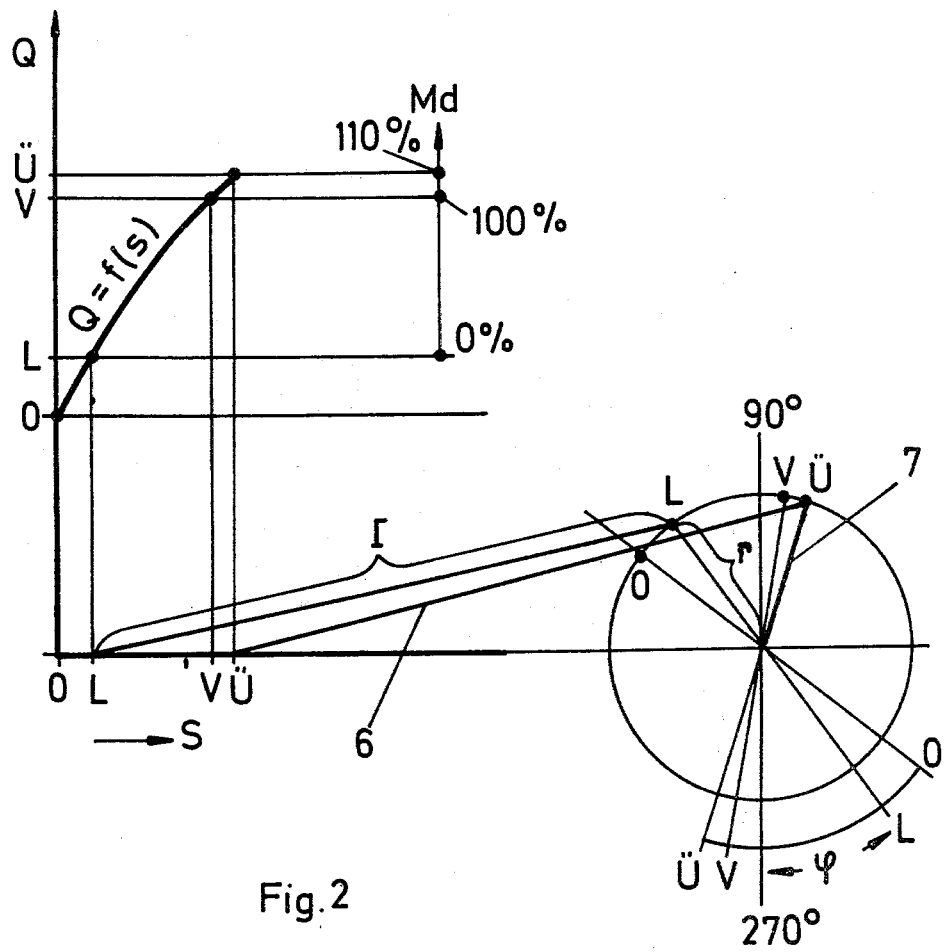
FIG. 2 shows a schematic of the device that converts the control rod displacement into a mechanical control variable which is proportional to the fuel quantity per power stroke; and, FIG. 3 shows the circuit diagram for the transducer.

FIG. 2 shows the mode of operation of the crank drive which comprises the connecting rod 6 and the crank arm 7. The left-hand shows the fuel quantity Q per power stroke plotted versus control rod displacements s. The curve shows that Q is not proportional to s. In this graph, O=zero position or fuel quantity equal to zero, L=idling position or idling fuel quantity, V=full load position or full load quantity, and U=overload position or overload fuel quantity. The ratio, shown in FIG. 2, of connecting rod length 1 to crank radius r has only been chosen for the sake of illustration. In actual constructions, a range for 1/r between 6:1 and 8:1 was found useful. On the right-hand side of the curve Q=f(s) is the useful torque Md delivered by the diesel engine. The bottom right shows the rotation angle $\phi$ into which displacement s is converted. Comparing the range of rotation angle $\phi$ between points U and L with the magnitude of Md in the same range, one finds that Md and $\phi$ are proportional to each other.

Figure 3:
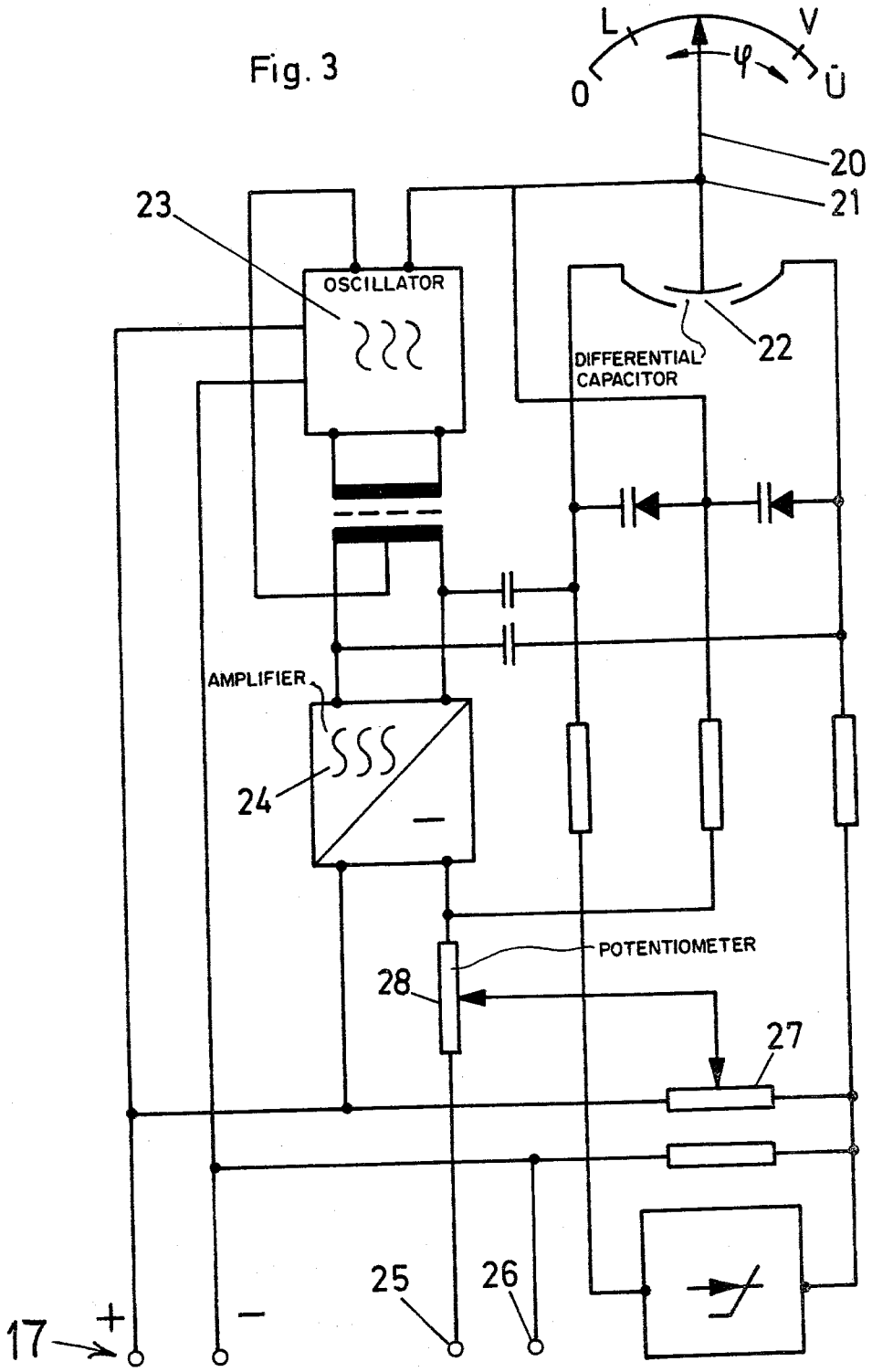

FIG. 3 shows transducer 8 in greater detail. The upper right shows the correcting element 20 which is pivoted by crank arm 7 about axis 21. The reference symbols O, L, V, U and $\phi$ are the same as in FIG. 2. The differential capacitor 22 belongs to a self-balancing capacitance bridge supplied with high-frequency current from oscillator 23. The high-frequency output voltage of the capacitance bridge is applied to amplifier 24 and converted there into a direct current signal which is proportional to the position of correcting element 20 and can be picked off terminals 25, 26. The position of the zero point can be varied with potentiometer 27. In this manner, the voltage on terminals 25, 26 can be made zero when the correcting element 20 is at point L. If L is the position of control rod 5, which results when diesel engine 2 drives the idling generator 1, then the idling losses of the generator and the frictional torque of the diesel engine are taken into consideration, i.e., the signals supplied by the measuring device 12 and by the transducer 8 are proportional to each other. This zero-point displacement constitutes a fixed magnitude. Hence, it corresponds to the conditions for diesel engines where the friction torque at constant speed is largely independent of load. This also applies to the generator losses so that there is no appreciable impairment of the functioning of comparator 16 by superimposing one or several fixed control magnitudes (range between points O and L) on the control variable. The setting can be made on the test stand. There the diesel engine runs at idling speed and with no load on the generator, with the potentiometer 27 being set so that there is no voltage on terminals 25, 26. With this setting, the measuring device 12 must not have an output voltage. The absolute value of the output signals on terminals 25, 26 can be set with the potentiometer 28, so that the absolute values of the two opposite signals can be made equal or nearly equal. The measuring device 12 also may have a similar adjustment facility. Altogether, the errors made in determining fuel quantity and useful torque ought to be small enough to discover an abnormal rise of fuel quantity of the order of 5% of the full load quantity. If the proportionality obtained by the device in accordance with FIG. 2 is not sufficiently accurate, a cam whose contour has been determined point by point with extreme accuracy may be used instead. The discovery of the above-mentioned 5% rise in fuel quantity would be sufficient to signal the missing of a cylinder in a nearly fully loaded sixteen-cylinder engine. To discover the start of piston seizing, an abnormal fuel quantity rise of about 12% of the full load quantity must be detectable with reliability.

The elements 9, 10 and 11 as well as 12 are of conventional construction and are commercially available. For this reason, these elements are not described in further detail here.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptation should and are intended to be comprehended within the meaning and range of equivalents of the following claims.

What is claimed is:

1. A safety device for a diesel engine and responding to an abnormal change of ratio of useful torque delivered by said diesel engine to fuel quantity per power stroke, said fuel quantity per power stroke being defined by position of an injection pump control rod, said safety device comprising: transducer means converting control rod displacement into a control signal which is at least substantially proportional to said fuel quantity per power stroke; correcting means; and crank drive means for converting control rod displacement into a rotation of said correcting means.

2. A safety device as defined in claim 1 including a connecting rod connected to said crank drive means, the ratio of connecting rod length to crank radius being within the range of substantially 6:1 and 8:1, said correcting means having a rotation angle of substantially less than 90° in the range between zero and full useful torque, said correcting means having a rotation angle range of 90° on either side of the crank position.

3. A safety device as defined in claim 1 wherein said transducer means generates an electrical control signal, said signal being a direct current signal proportional to said rotation angle of said correcting means.

4. A safety device for a diesel engine and responding to an abnormal change of ratio of useful torque delivered by said diesel engine to fuel quantity per power stroke, said fuel quantity per power stroke being defined by position of an injection pump control rod, said safety device comprising: transducer means converting control rod displacement into a control signal which is at least substantially proportional to said fuel quantity per power stroke; speed regulator means for said diesel engine; means emitting at least a warning and actuated by a change in the ratio of useful torque to fuel quantity; time delaying means connected in series with said warning means and having a time lag which is at least equal to the control stabilization time of said speed regulator means.

5. A safety device as defined in claim 4 wherein said warning is emitted when non-proportionality prevails between useful torque and fuel quantity, a variation of useful torque producing non-proportionality between fuel quantity per power stroke and useful torque so that said control rod is displaced by said speed regulator means for applying maximum possible amount of fuel quantity to the engine, said control rod becoming displaced into a position corresponding to proportionality again between fuel quantity per power stroke and useful torque when the engine has again attained a predetermined operating speed at the end of a predetermined regulating period.

6. A safety device as defined in claim 4 including electrical generator means driven by said diesel engine at substantially constant feed for power generation; first means for producing an electrical signal at least substantially proportional to fuel quantity per power stroke; second means for producing a signal proportional to the output of said generator means, said signals from said first and second signal producing means cancelling each other in normal operation of said diesel engine; comparator means connected to said first and second signal producing means, said comparator means having an output signal providing at least a warning when one of the signals from said first and second signal producing means has an abnormal preponderance.

7. A safety device as defined in claim 6 including means for superimposing a fixed control signal on the signal corresponding to fuel quantity per power stroke to allow for normal engine friction torque.

8. A safety device as defined in claim 7 including means for superimposing a fixed signal on the signal corresponding to fuel quantity per power stroke to allow for torque representing idling losses of said generator means.

9. A safety device as defined in claim 8 including zero adjusting means on said transducer means for superimposing the fixed control signals to allow for normal engine friction torque and the torque representing idling losses of said generator means.

10. A safety device as defined in claim 6 including means for ceasing operation of said engine when the output of said comparator means has a signal corresponding to abnormal preponderance of one of the two signals from said first and second signal producing means.

* * * * *